US012011049B2

(12) United States Patent
Batista

(10) Patent No.: US 12,011,049 B2
(45) Date of Patent: Jun. 18, 2024

(54) AEROSOL GENERATING ARTICLE, AEROSOL-GENERATING SYSTEM AND METHOD FOR MANUFACTURING AN AEROSOL-GENERATING ARTICLE

(71) Applicant: PHILIP MORRIS PRODUCTS S.A., Neuchatel (CH)

(72) Inventor: Rui Nuno Batista, Morges (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 367 days.

(21) Appl. No.: 15/769,791

(22) PCT Filed: Oct. 21, 2016

(86) PCT No.: PCT/EP2016/075317
§ 371 (c)(1),
(2) Date: Apr. 20, 2018

(87) PCT Pub. No.: WO2017/068101
PCT Pub. Date: Apr. 27, 2017

(65) Prior Publication Data

US 2018/0310623 A1 Nov. 1, 2018

(30) Foreign Application Priority Data

Oct. 22, 2015 (EP) ..... 15190943

(51) Int. Cl.
*A24D 1/14* (2006.01)
*A24C 5/01* (2020.01)
(Continued)

(52) U.S. Cl.
CPC ..... *A24F 7/00* (2013.01); *A24C 5/01* (2020.01); *A24D 1/14* (2013.01); *A24D 1/20* (2020.01);
(Continued)

(58) Field of Classification Search
CPC ..... A24F 47/008; A24F 40/42; A24F 40/46; A24F 40/465; A24D 1/14; A61M 15/06
(Continued)

(56) References Cited

U.S. PATENT DOCUMENTS 38,052 A * 3/1863 Mallett ..... A24D 1/14 131/348
3,766,929 A * 10/1973 Roman, Sr. ..... A24D 1/14 131/119
(Continued)

FOREIGN PATENT DOCUMENTS

CN 201479921 U 5/2010
CN 103987286 A 8/2014
(Continued)

OTHER PUBLICATIONS

Mei, Xiaoyu, "Derwent Abstract for CN 204120237 U," Jan. 2015, Derwent. (Year: 2015).*
(Continued)

*Primary Examiner* — Philip Y Louie
*Assistant Examiner* — Sonny V Nguyen
(74) *Attorney, Agent, or Firm* — Oblon, McClelland, Maier & Neustadt, L.L.P.

(57) ABSTRACT

The aerosol-generating article (1) for use in an electronic aerosol-generating device (8) comprises an aerosol-forming substrate, wherein the aerosol-generating article has a shape comprising a hollow frustum with an open base (10). An aerosol-generating system (8) comprising such an aerosol-generating article (1) comprises a heating element (2) having a shape comprising a frustum, wherein a height of the heating element (2) corresponds to a height of the aerosol-generating article (1).

17 Claims, 3 Drawing Sheets

(51) Int. Cl.

| | |
|---|---|
| ***A24D 1/20*** | (2020.01) |
| ***A24F 7/00*** | (2006.01) |
| ***A24F 40/20*** | (2020.01) |
| ***A24F 40/46*** | (2020.01) |
| ***A24F 40/465*** | (2020.01) |

(52) U.S. Cl.
CPC ..... *A24F 40/46* (2020.01); *A24F 40/465* (2020.01); *A24F 40/20* (2020.01)

(58) Field of Classification Search
USPC ..... 131/280
See application file for complete search history.

(56) References Cited

U.S. PATENT DOCUMENTS

| | | | | |
|---|---|---|---|---|
| 3,905,377 | A * | 9/1975 | Yatrides | A24F 1/02 131/336 |
| 2013/0319407 | A1 | 12/2013 | Liu | |
| 2014/0076310 | A1 | 3/2014 | Newton | |
| 2014/0202476 | A1* | 7/2014 | Egoyants | H05B 3/44 131/329 |
| 2014/0261495 | A1* | 9/2014 | Novak, III | A24F 47/008 131/329 |
| 2015/0157055 | A1* | 6/2015 | Lord | H05B 3/16 131/329 |
| 2016/0081394 | A1* | 3/2016 | Alarcon | A24D 3/04 131/328 |
| 2016/0100624 | A1* | 4/2016 | Yilmaz | A24B 3/14 131/367 |
| 2016/0143360 | A1* | 5/2016 | Sanchez | A24F 47/008 239/302 |
| 2016/0360785 | A1* | 12/2016 | Bless | A24F 47/008 |
| 2017/0055574 | A1* | 3/2017 | Kaufman | H05B 6/105 |
| 2017/0055580 | A1* | 3/2017 | Blandino | H05B 6/36 |
| 2017/0079330 | A1* | 3/2017 | Mironov | H05B 6/108 |
| 2018/0343917 | A1* | 12/2018 | Sutton | A24F 40/42 |

FOREIGN PATENT DOCUMENTS

| | | | | |
|---|---|---|---|---|
| CN | 204120237 | U | 1/2015 | |
| DE | 9306986 | U1 | 8/1993 | |
| EP | 3 153 035 | A1 | 4/2017 | |
| WO | WO 95/27411 | | 10/1995 | |
| WO | WO-2009079641 | A2 * | 6/2009 | A24F 40/10 |
| WO | WO 2013/120855 | | 8/2013 | |
| WO | WO 2015/101479 | | 7/2015 | |
| WO | WO 2016/007516 | | 1/2016 | |
| WO | WO-2016156509 | A1 * | 10/2016 | A24F 40/42 |
| WO | WO 2016/200815 | A2 | 12/2016 | |

OTHER PUBLICATIONS

PCT Search Report and Written Opinion for PCT/EP2016/075317 dated Jan. 24, 2017 (12 pages).
Combined Chinese Office Action and Search Report dated Apr. 29, 2020, in Patent Application No. 201680055042.2 (with English translation), 20 pages.
European Office Action dated Oct. 12, 2020 in European Patent Application No. 16787780.2, 4 pages.
Office Action dated Nov. 12, 2020 in corresponding Japanese Patent Application No. 2018-520478 (with English Translation), 10 pages.

* cited by examiner

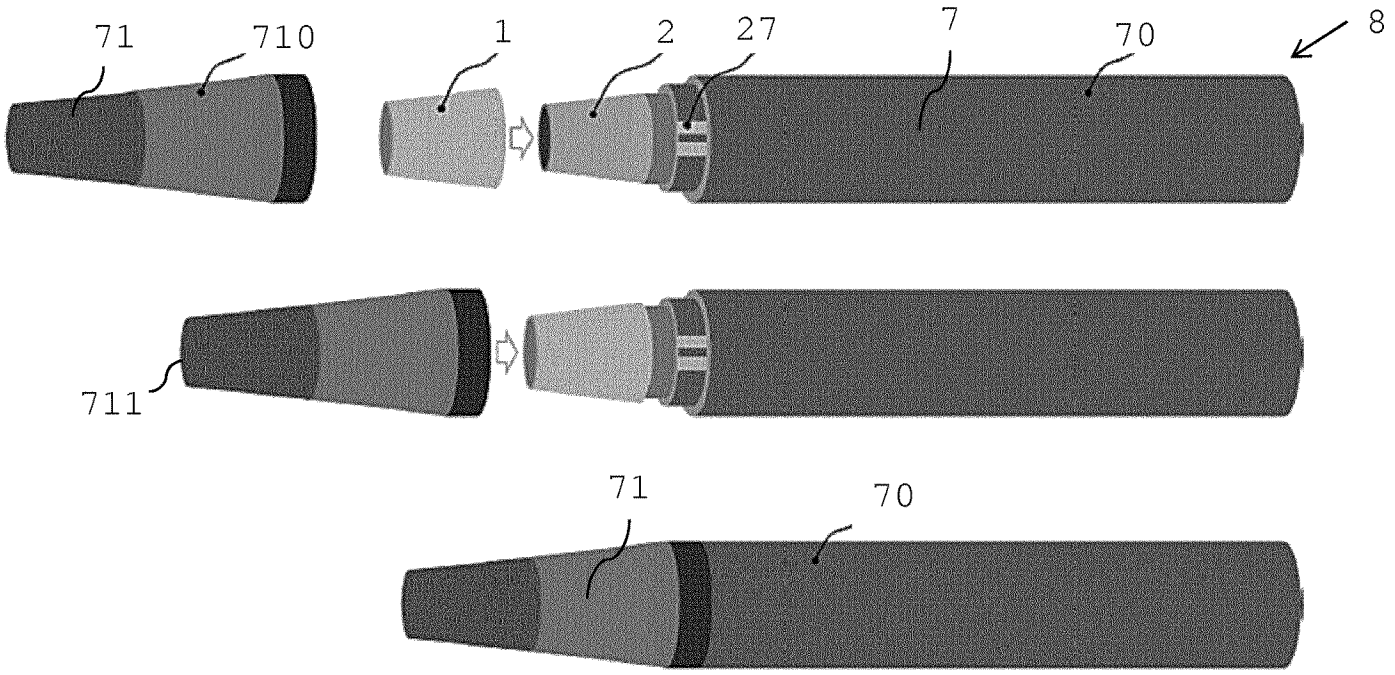
Fig. 10a
Fig. 10b
Fig. 10c
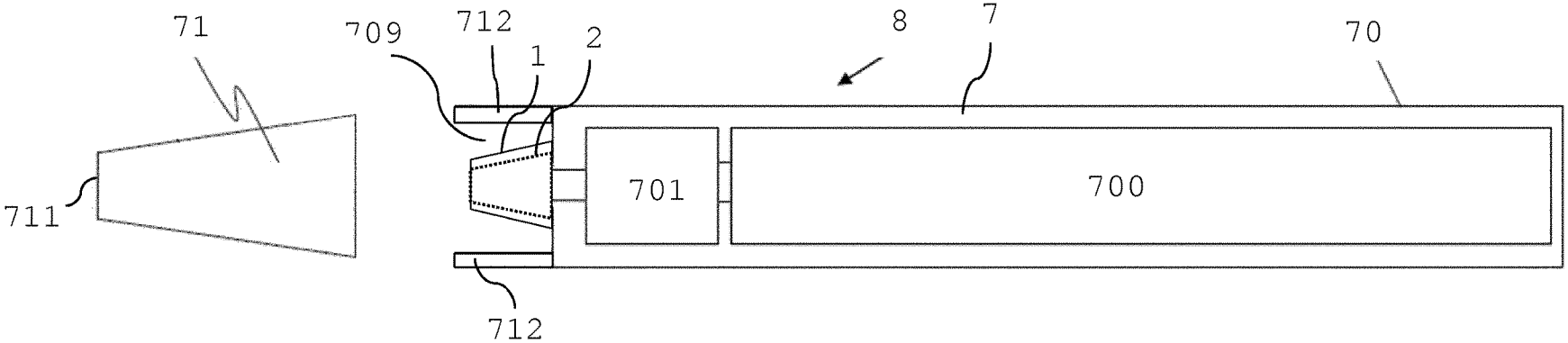
Fig. 11

AEROSOL GENERATING ARTICLE, AEROSOL-GENERATING SYSTEM AND METHOD FOR MANUFACTURING AN AEROSOL-GENERATING ARTICLE

This application is a U.S. National Stage Application of International Application No. PCT/EP2016/075317, filed Oct. 21, 2016, which was published in English on Apr. 27, 2017, as International Publication No. WO 2017/068101 A1. International Application No. PCT/EP2016/075317 claims priority to European Application No. 15190943.9 filed Oct. 22, 2015.

The invention relates to an aerosol-generating article for use in an electronic aerosol-generating device. The invention also relates to an aerosol-generating system comprising such an aerosol-generating article and a method for manufacturing such an aerosol-generating article.

Various aerosol-generating articles for use in electronic heating devices are known. The aerosol-generating article comprises an aerosol-forming substrate, which is heated by a heating element. Typically, a heating blade is inserted into a tobacco plug for heating the plug. The heating blade has limited heating effect on peripheral portions of the plug, while central portions tend to be overheated. Thus, upon disposal of an aerosol-generating article, it may still comprise unused tobacco substrate. With inductively heated tobacco plugs, generally additional waste is generated since susceptor material comprised in a tobacco plug is disposed of after use of the aerosol-generating article.

Thus there is need for an aerosol-generating article with reduced material waste. In addition, it would be desirable to have an aerosol-generating system comprising such an aerosol-generating article with reduced material waste.

According to an aspect of the present invention, there is provided an aerosol-generating article for use in an electronic aerosol-generating device. The aerosol-generating article comprises an aerosol-forming substrate. The aerosol-generating article has a shape comprising a hollow frustum with an open base. Preferably, the shape of the aerosol-generating article is a hollow frustum with an open base.

According to another aspect of the present invention, there is also provided an aerosol-generating system. The aerosol-generating system comprises an aerosol-generating article according to the invention. The system also comprises an aerosol-generating device comprising a mouthpiece and a device housing. The device housing comprises a heating element having the shape of a frustum, preferably a hollow frustum. The aerosol-generating article is mounted to the heating element of the device, for example, is provided over the heating element. Therein a height of the heating element corresponds to a height of the aerosol-generating article. Corresponding heights of heating element and aerosol-generating article are herein understood such that the frustum of the article and of the heating element may have equal heights. Corresponding heights are herein also understood to include heights which differ, for example, by a thickness value of a top of the hollow frustum of the aerosol-forming article. Corresponding heights of heating element and aerosol-generating article may include identical height values as well as a range of height values corresponding to the identical value plus or minus 20 percent.

The aerosol-generating article according to the invention may be placed onto the heating element of the aerosol-generating device, such as, for example, an e-cigarette, via the open base of the hollow frustum. By this, the aerosol-generating article may be centered on the heating element through its conical shape. In addition, a close contact of the aerosol-forming substrate of the aerosol-generating article and the surface of the heating element may be provided. Preferably, the shape of the heating element matches the shape of the aerosol-generating article. In addition, by mounting the aerosol-generating article onto the heating element also comprising a conical shape, a shape of the article may automatically be corrected to its intended shape in case of a deformed article, for example through handling of the article. Through adaption of the sizes and shapes of the aerosol-generating article and the heating element, a very close and basically overall contact between heating element and article may be achieved. In particular, through adaption of the height of the heating element and the height of the article, the article may very directly be heated over its entire height or length. Vice versa, no portion of the heating element is heated without heating aerosol-forming substrate. Thus, no heating energy is wasted.

Heat transfer from the heating element to the aerosol-forming substrate of the aerosol-forming article may thus be made very efficient, in particular since the aerosol-generating article is primarily made of aerosol-forming substrate. In addition, a contact area between heating element and aerosol-forming substrate of the aerosol-forming article is large compared to, for example, a contact area between a heating blade and surrounding aerosol-forming substrate as known from conventional electronic heating devices. A large contact area improves energy efficiency of a device, which may lead to energy savings. This may lead, for example, to longer operation time of a device or, for example, to the provision of smaller size and capacity of batteries. Improved heat transfer and large contact area may also lead to a faster heating of the aerosol-forming substrate and thus to smaller start-up times for a device to get ready for use. Yet further, a more homogeneous temperature distribution in the aerosol-forming substrate may be achieved. In addition, portions of aerosol-forming substrate where a temperature required for releasing volatiles forming aerosol is not reached or where overheating of the substrate occurs may get very small or may even be non-existent. This may be favourable in view of taste and delivery over time enhancing the quality of the consuming experience. Alternatively or in addition, an amount of aerosol-forming substrate may possibly be reduced, however, by a same amount of aerosol available. Since the heating element is arranged in the aerosol-generating device, also in case of inductive heating, no material of the heating device is disposed of after use of an aerosol-generating article, since the heating element forms part of the device.

With the aerosol-generating article and system according to the invention, a more efficient use of the aerosol-forming substrate and less waste of unused substrate or as the case may be, inductively heatable material, may be achieved.

The shape of the aerosol-generating article may very generally be described as comprising or being a tubular body having conical side walls.

The shape of the aerosol-generating article may include a hollow frustum with an open base or may be a hollow frustum with an open base. If the shape includes a hollow frustum, the shape may, for example be any kind of pyramid or a cone. If the shape is a hollow frustum, the shape may, for example be any kind of truncated pyramid or a truncated cone. If the frustum is a pyramid or truncated pyramid, the base of the frustum may be any kind of polygon, preferably a regular polygon. If the frustum is a cone or truncated cone, that is, if the frustum is a circular frustum, the base of the frustum may be a circle or an ellipse. Preferably, the base is a circle.

Preferably, the hollow frustum is a right hollow frustum, where the axis of the frustum through the base and the top of the frustum is perpendicular to the base and the top.

The hollow frustum may basically be any kind of hollow pyramid or cone. Preferably, the hollow frustum is a truncated pyramid or truncated cone. The top of the frustum may be closed or may be open. A hollow truncated frustum with a closed top has the form of a (inverted) cup.

An apex angle of the hollow frustum may be between 1 degree and 30 degree. Preferably, the apex angle is between 1.5 degree and 10 degree, for example between 2 degree and 5 degree.

The apex angle is herein understood as the angle at the vertex of the frustum (the tip of the cone or pyramid) between the frustum axis and a surface line (generatrix). In a truncated frustum, the apex angle is a virtual angle defined by the virtual cross-section of the frustum axis and a surface line.

For a frustum having a base in the form of a polygon, the apex angle is understood to be the apex angle of a corresponding cone having a base being the circumcircle of the polygon (directrix).

The conical shape of the aerosol-generating article allows for a self-fitting and tight fitting of the article on a heating element of the device. It has been found that cone or frustum shapes having apex angles in the defined range, secure and simplify a placing of an aerosol-generating article on a heating element. They also simplify removal of the article after use. Too large apex angles may lead to a slipping of the article from the heating element upon positioning on the heating element, while an apex angle of 0 degree (tube) may have no self-centering or self-fitting effect depending on a shape or arrangement of a heating element.

As a general rule, whenever a value is mentioned throughout this application, this is to be understood as the exact value to be explicitly disclosed. However, a value is also to be understood as not having to be exactly the particular value due to technical considerations. A value may, for example, include a range of values corresponding to the exact value plus or minus 20 percent.

A wall thickness of a lateral surface area of the hollow frustum may be between 0.3 millimeter and 3 millimeter. Preferably, the wall thickness is between 0.3 millimeter and 1.5 millimeter. More preferably, the wall thickness of the lateral surface area of the hollow frustum is between 0.3 millimeter and 1 millimeter.

A wall thickness may be constant over a height of the hollow frustum or over a height of the aerosol-generating article.

A wall thickness may also vary over a height of the hollow frustum. For example, a wall thickness may be larger versus the top of the frustum and smaller versus the base of the frustum.

An outer base diameter of the hollow frustum of the article may be between 4 millimeter and 10 millimeter. Preferably the base diameter is between 5 millimeter and 8 millimeter. In case of the hollow frustum having a base in the form of a polygon, the base diameter is understood to define the diameter of the corresponding circumcircle of the polygon.

An outer diameter of the top of the hollow frustum may be between 2 millimeter and 6 millimeter. Preferably, the top diameter is between 4 millimeter and 5 millimeter.

A height of the aerosol-generating article may be between 4 millimeter and 15 millimeter. Preferably the height is between 5 millimeter and 12 millimeter. The height of the article preferably corresponds to the height of the hollow frustum.

The height of a frustum is understood as the perpendicular distance between the planes of the base and the top of the frustum. If the shape of the aerosol-generating article is a cone or pyramid, the height is the distance between the vertex and the base of the cone or pyramid.

A lateral surface area of the hollow frustum of the aerosol-generating article, that is the sides of the frustum, may be flat or may be structured. A flat lateral surface area represents the minimal lateral surface area of a respective frustum. With a structured lateral surface area the total lateral surface area may be increased. By this, a surface area for aerosol formation and evaporation may be increased. Also a total contact area between a heating element and the aerosol-generating article may be increased. Preferably, the form of the heating element is adapted to the corresponding structure of the lateral surface area. An increase of contact area through such a structure may, for example, be achieved without changing the height of the aerosol-generating article.

With a structured lateral surface area also the amount of aerosol-forming substance per article may be enhanced, preferably without enhancing a thickness of the article. This enables an extension of a consuming experience or additionally or alternatively an increase of an aerosol delivery during a consuming experience.

Preferably, a structure of the lateral surface area is a regular structure. Preferably, a structure is adapted to the size of the frustum and its position on the frustum. For example, a structure may be smaller at or versus the top of the frustum and may be larger at or versus the base of the frustum. A structure may, for example, be converging or discontinuing versus the top of the frustum.

If the aerosol-generating article comprises the shape of a hollow pyramid, the structure may overlie a wall arrangement of the pyramid.

A structured lateral surface area may, for example, be a wavy lateral surface area, wherein a circumference of the shape of the frustum describes a wavy line.

The aerosol-forming substrate comprised in the aerosol-generating article is a substrate capable of releasing volatile compounds that can form an aerosol. Volatile compounds may be released by heating or combusting the aerosol-forming substrate. An aerosol-forming substrate may be solid. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, the aerosol-forming substrate is a tobacco sheet such as a cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between 30 micrometer to 250 micrometer, preferably in the order of 30 micrometer to 80 micrometer or 100 micrometer to 250 micrometer, depending on the desired article dimensions.

Fiber particles may include tobacco stem materials, stalks or other tobacco plant material, and other cellulose-based fibers, such as wood fibers having a low lignin content. Fiber particles may be selected based on the desire to produce a sufficient tensile strength for the article versus a low inclusion rate, for example, a rate between approximately 2 percent to 15 percent. Alternatively, fibers, such as vegetable fibers, may be used either with the above fibers or in the alternative, including hemp and bamboo.

Aerosol formers included in the slurry forming the aerosol-forming substrate may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce aerosol-forming substrate slurry includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to the article or generally to the aerosol-forming substrate, the amount of fibers may be reduced or fibers may even be omitted due to the aerosol-forming substrate being stabilized by its shape and size and the heating element the article is to be mounted on.

If present, the fiber solution and the prepared tobacco are then mixed. The slurry is then transferred to an article manufacturing apparatus, for example a molding apparatus. Preferably, the tobacco containing slurry comprises homogenized tobacco material and comprises glycerin as aerosol former. After manufacturing, preferably molding, the aerosol-generating articles, the substrate is then dried, preferably by heat and cooled after drying.

Preferably, the aerosol-forming substrate of the aerosol-generating article comprises tobacco material and an aerosol-former.

The aerosol-generating article may further comprise a wrapping material. The wrapping material at least partly covers the aerosol-generating article. The wrapping material may cover at least one of an inside of the aerosol-generating article or an outside of the aerosol-generating article. The wrapping material may cover at least one of the inside of the lateral surface area or an outside of the lateral surface area of the hollow frustum.

Preferably, the wrapping material covers the inside and the outside of the aerosol-generating article. The wrapping material may cover the inside and the outside of the lateral surface area of the hollow frustum.

The wrapping material may also cover the top of a truncated frustum such that the frustum is closed, for example, by the wrapping material only.

The wrapping material may serve as an interface between a heating element and the aerosol-generating article or the aerosol-forming substance of the aerosol-generating article, respectively. By this, the heating element may be kept clean, also after consecutive usage of a device. Removal of the used aerosol-generating article may also be facilitated, avoiding or limiting sticking of a used article to residues on a heating element.

The wrapping material may serve as protection to avoid direct contact between the aerosol-forming substrate and the fingers of a user touching the aerosol-generating article.

The wrapping material may basically be any kind of material suitable for use in an electronic heating device.

Preferably, the wrapping material is a material that does not dissolve or change its main physical characteristics during a heating process in use of a device. Preferably, the wrapping material is a very thin sheet material.

The wrapping material may be the same or may be different for an inside and an outside of an aerosol-generating article.

Preferably, the wrapping material, in particular the wrapping material for an outside of the aerosol-generating article, is porous. The porosity is selected such as to enable free release of the aerosol evaporating from the heated aerosol-forming substrate.

The wrapping material may, for example, be a cellulose based material, including paper materials that comply with regulations of food and beverage industry and for example of the FDA. The wrapping material may be a cigarette paper, a "tea-bag" paper or a medical grade or food and beverage approved porous sheet material, for example, such paper or plastics sheet material. Tea bag paper suitable for use as wrapping material in aerosol-generating articles according to the invention may have densities in a range of between 15 $g/m^2$ and 25 $g/m^2$, preferably between 18 $g/m^2$ and 22 $g/m^2$ (for example commercially available type IMA 21, 23, 24 and 27, non-heat sealable tea bag paper).

A thickness of the wrapping material may, for example, be in a range between 10 micrometer and 50 micrometer, preferably between 10 micrometer and 30 micrometer.

The aerosol-generating article is primarily made from an aerosol-forming substrate. 'Primarily' is herein understood such that the article may entirely be made from aerosol-forming substrate. However, the aerosol-generating article may also comprise small amounts of other materials, for example, a wrapping material as described above, for example on an outside or on an inside of the article.

The aerosol-generating article may be very generally used in electronic heating devices, that is, independent of the manner a heating element of the device is heated. The aerosol-generating article may be used in combination with resistive heating or with inductive heating of the heating element.

Preferably, the aerosol-generating article according to the invention is used in the aerosol-generating system according to the invention. Therein, the article is mounted to the heating element of the device, preferably entirely put over the heating element of the device. To optimize a matching of the shapes of the aerosol-forming article and the heating element, the heating element also has a shape comprising a frustum, and the height of the heating element substantially corresponds to the height of the aerosol-generating article.

Preferably, the apex angle of the frustum of the heating element is between 1 degree and 30 degree. More preferably, the apex angle is between 1.5 degree and 10 degree, for example between 2 degree and 5 degree.

Preferably, the apex angle of the frustum of the heating element is chosen to correspond to the apex angle of the hollow frustum of the article.

Preferably, a top diameter of the frustum of the heating element corresponds to the inner diameter of the top of the hollow frustum of the article. A top diameter of the frustum of the heating element preferably lies in a range between 1.4 mm and 5.5 mm.

Preferably, a base diameter of the frustum of the heating element corresponds to the inner diameter of the base of the hollow frustum of the article. A base diameter of the frustum of the heating element preferably lies in a range between 4.4 mm and 9.5 mm.

Preferably, the shape of the frustum of the heating element may be designed and varied as the shape of the hollow frustum of the aerosol-generating article and as described herein. However, the frustum of the heating element may be a solid or hollow frustum and, preferably, the frustum of the heating element comprises a closed top.

Preferably, an aerosol-generating device, in particular the heating element of the device, is configured to allow easy application of the aerosol-generating article onto the heating element. Preferably, the device allows easy and open access to the heating element, for example, for cleaning or replacement of the heating element.

A heating element may, for example, extend over a proximal end of the device housing. This favours an unhindered access to the heating element. In those embodiments, a longitudinal axis of the aerosol-generating article corresponding to a frustum axis of the heating element is preferably aligned with a longitudinal axis of the device housing.

A heating element may also, for example, be arranged in a recess or cavity in the device housing. A recessed arrangement shields the heating element as well as a mounted aerosol-generating article. It also protects a user from touching the same elements in an open state of the housing, that is before assembling the mouthpiece and the device housing.

An aerosol-generating article mounted on the heating element may entirely or partially be covered by the mouthpiece of the device.

The mouthpiece may have an internal conical wall arranged at an upstream end of the mouthpiece, such that in an assembled state of the device, the internal conical wall of the mouthpiece and a lateral surface area of the frustum of the heating element may be arranged at a predefined distance and next to each other. This embodiment of a mouthpiece is in particular favourable if the heating element extends from the proximal end of the device housing.

The predefined distance is selected to allow an aerosol-generating article to be arranged in the space between heating element and internal conical wall of the mouthpiece.

Preferably, the predefined distance is selected to leave a predefined air-path between the outside of the aerosol-generating article and the internal conical wall of the mouthpiece.

The lateral surface area of the frustum of the heating element may be arranged equidistantly to the internal conical wall of the mouthpiece. Such embodiments may be favourable for aerosol-generating articles having a constant wall thickness.

The mouthpiece is the most downstream element of the aerosol-generating device. A user contacts the mouthpiece in order to pass an aerosol generated by the aerosol-generating article through the mouthpiece to the user. A mouthpiece may comprise a filter segment. A filter segment may have low particulate filtration efficiency or very low particulate filtration efficiency. A filter segment may be longitudinally spaced apart from the aerosol-forming substrate. A filter segment may be a cellulose acetate filter plug made of cellulose acetate tow.

The mouthpiece may further comprise a mixing chamber for homogenizing an air-flow through the mouthpiece before the air-flow leaves the mouthpiece. The mixing chamber is arranged downstream of the heating element in the system according to the invention. The mixing chamber may for example be arranged downstream of an internal conical wall arranged at the upstream end of a mouthpiece.

An air-flow passing the aerosol-generating article may pick up evaporated aerosol and passes the mixing chamber preferably in a turbulent flow. Thus, the chamber has a blending effect, homogenizing an aerosol flow before the aerosol flow leaves the mouthpiece.

As used herein, the terms 'upstream' and 'downstream' or 'distal' and 'proximal' when used to describe the relative positions of elements or segments, or portions of elements or segments, of the aerosol-generating article or aerosol-generating device or system in relation to the direction in which a user draws on the aerosol-generating article during use thereof.

The mouthpiece may comprise a support element arranged inside the mouthpiece. Preferably, the support element is arranged within an air-flow passageway inside the mouthpiece. Preferably, a support element is arranged coaxially with the heating element.

The support element may be a centering element for supporting a positioning and self-centering of the aerosol-generating article on the heating element and in the aerosol-generating device.

The support element may be an air-flow alteration element supporting a mixing of an air-flow with evaporated aerosol and homogenization of an aerosol flow before leaving the mouthpiece.

The support element is at least one of a centering element and an air-flow alteration element. More preferably, the support element is a combination of a centering element and an air-flow alteration element.

A support element may be attached to the mouthpiece, for example by fins. Preferably, fins or other attachments means are designed to cope with a desired airflow management.

A support element may be arranged downstream of the heating element, for example, directly adjacent the heating element. A support element, in particular a support element solely acting as positioning element, may be arranged at the proximal end of the mouthpiece or in the region of the internal conical wall of the mouthpiece facing the heating element or the aerosol-generating article mounted on the heating element, respectively.

A support element may have an internal path or several internal paths for an air-flow to pass through. In embodiments where the aerosol-generating article has the shape of a hollow frustum with an open top, an air-flow through the inside of the heating element preferably passes through the internal paths of the support element. An airflow passing on the outside of the heating element preferably passes the outside of the support element. An air-flow through the support element and an air-flow outside of the support element may be combined in the mixing chamber.

The aerosol-generating system may be a resistively heated system or may be an inductively heated system. The heating element, a device electronics and power supply is configured accordingly.

In a resistively heated system, the heating element comprises resistively heatable material. The heating element is directly coupled to a power source and is heated through resistive losses in the material. Preferably, in these embodiments the heating element is a resistively heatable hollow truncated cone. For example, the resistively heatable material may be embedded in an epoxy resin and potted into a thermally conductive material in the form of a hollow frustum forming an electric heater.

Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys.

In an inductively heated system, the heating element comprises an inductively heatable material, that is, a susceptor material. An inductor of a load network connected to a power supply is arranged such that the inductor may be inductively coupled to the inductively heatable material of the heating element during operation of the system. Preferably, in these embodiments the heating element is an inductively heatable hollow truncated cone. The hollow cone may for example be made of a ferromagnetic metal alloy fastened to an element, for example a core, made of non-ferromagnetic material, for example a ceramic.

Suitable inductively heatable materials, so-called 'susceptors' include but are not limited to any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

In an inductively heated aerosol-generating system, the inductor may be arranged in the device housing or in the mouthpiece. Preferably, the inductor is in the form of a coil. The coil may be arranged and embedded in a device housing portion surrounding the recess where the heating element in arranged in. The coil may also be arranged and embedded in a mouthpiece portion surrounding the cavity where the heating element in arranged in, for example in the conically shaped wall portion of the mouthpiece.

The heating element, independent of being resistively or inductively heated, may be designed for segmented heating. The heating element may comprise several, for example, two or three, individual segments. The individual segments are electrically insulated from each other. One or more segments may be heated simultaneously. The segments may be heated sequentially.

The segments may be heated, for example, via a set of inductor coils. Preferably, the set of inductor coils comprises a same number of inductor coils as heating segments are comprised in the heating element. Each inductor coil is then provided for heating a segment of the heating element.

According to another aspect of the present invention, there is also provided a method for manufacturing an aerosol-generating article, preferably an aerosol-generating article according to the present invention and as described herein. The method comprises the step of providing a female mold and a male mold. In a closed position of the molds, the female mold and the male mold include a molding space in between the female mold and the male mold. The molding space has the shape of a hollow frustum. Preferably, the male mold and the female mold have corresponding shapes. The male mold has the form of a frustum, preferably a truncated frustum. The female mold includes a cavity in the form of a frustum, preferably a truncated frustum.

The method further comprises the steps of supplying an aerosol-forming substrate in between the female mold and the male mold and closing the female mold and the male mold. Thereby, an aerosol-generating article in the shape of a hollow frustum, preferably a truncated hollow frustum is formed. Depending on the moisture level of the aerosol-forming substrate used in the method, the method may comprise a consecutive drying step.

An aerosol-forming substrate, for example a tobacco containing slurry, may be filled into the female mold. The aerosol-forming substrate may also be available in a sheet-like form, for example a cast leaf, such that pre-cut pieces of aerosol-forming substrate may be supplied to the male or female mold.

Upon closing the molds, the molds are moved relative to each other and into each other. Forms of the molds may be chosen and constructed according to the shapes of the aerosol-generating article as described herein.

A tobacco containing slurry may, for example, be supplied from a slurry reservoir and cast into a mold, preferably in a metered amount forming the article.

When using slurries of aerosol-forming substrates to form the article, also other molding techniques, such as for example suction molding may be used to bring the slurry into the form of the mold.

If an aerosol-generating article shall be provided with a wrapping material, a piece of wrapping material may be provided before, during or after molding the aerosol-generating article. For example, a piece of aerosol-forming substrate may be provided with wrapping material (on one or both sides). A wrapping material may also be provided either to the male mold or to the female mold or to both the male mold and the female mold. A wrapping material may be provided either to an inside or an outside or to an inside and an outside of the aerosol-generating article after performing the step of forming the aerosol-generating article according to the invention.

It is obvious that method steps may be added, switched or varied in order to provide wrapping material, for example depending on the provision of the wrapping material before casting the aerosol-forming substrate or after casting the aerosol-forming substrate, or both before as well as after casting the aerosol-forming substrate. However, a wrapping material is preferably provided before a drying step and before the aerosol-generating article is removed from a molding apparatus. It is also obvious that several pairs of molds may be provided for a mass production of aerosol-generating articles.

The invention is further described with regard to embodiments, which are illustrated by means of the following drawings, wherein.

FIG. 10*a-c* are exploded and an assembled view of an embodiment of an aerosol-generating system with protruding heating element;

FIG. 11 is a schematic illustration of an embodiment of an aerosol-generating system with shielded heating element.

Figure 1:
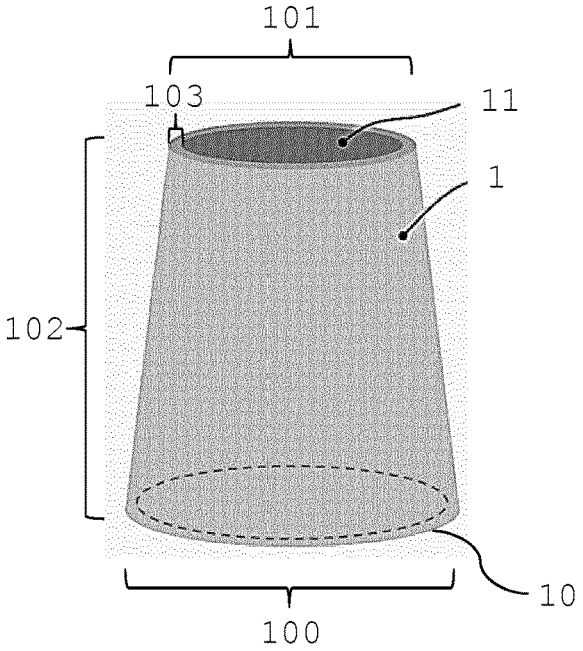
FIG. 1 shows an aerosol-generating article.
Figure 2:
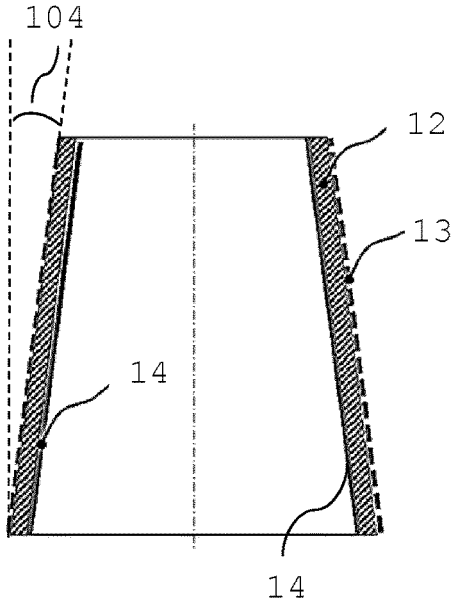
FIG. 2 shows a cross section through an aerosol-generating article, for example as shown in FIG. 1.

FIG. 1 shows an aerosol-generating article 1 in the form of a truncated cone having an open top 11 and an open base 10. The cone is made of an aerosol-forming substrate, preferably a tobacco containing substrate. The base 10 of the cone has an outer diameter 100 between 5 mm and 8 mm. The top 11 of the cone has an outer diameter 101 between 5 mm and 8 mm. The height 102 of the cone is between 4 mm and 15 mm. The wall thickness 103 of the cone is between 0.3 mm and 1 mm. The thickness 103 may vary along the height 102 of the cone according to an intended aerosolisation performance of the article. An apex angle 104 of the article 1 is between 2 degree and 10 degree. The apex angle 104 is indicated in FIG. 2 (for illustrative reasons drawn from the base 10 of the cone), which shows a cross section of an aerosol-generating article in the form of a truncated cone. The aerosol-forming substrate 12 is provided on its outside with a layer 13 of porous material, for example a "tea-bag" paper. The porosity of the layer 13 enables free release of aerosol from the substrate 12 and avoids direct contact between the substrate 12 and a user. The aerosol-forming substrate 12 is covered on its inside with a layer 14 of cigarette paper. The purpose of the cigarette paper is to avoid direct contact between the substrate 12 and an external surface of a heating element.

Figure 3:
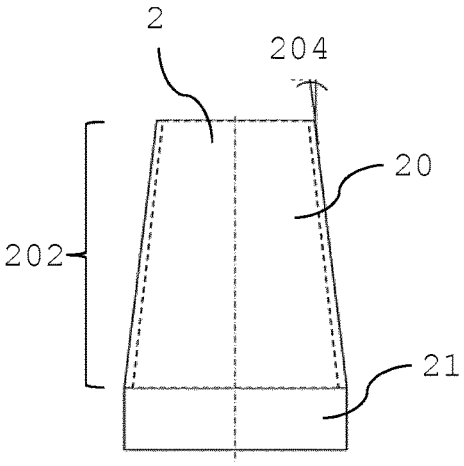
FIG. 3 is a schematic illustration of a heating element.
Figure 4:
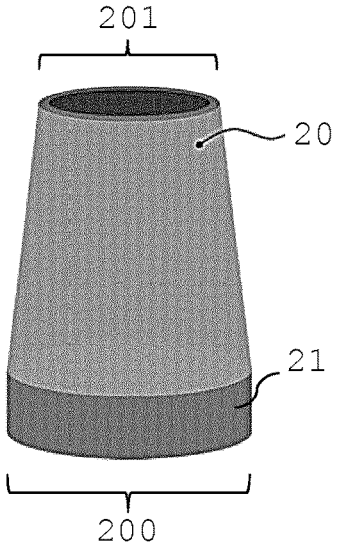
FIG. 4 shows a heating element.

FIG. 3 and FIG. 4 are illustrations of a heating element 2 comprising a portion in the form of a truncated cone 20 and a tubular portion 21.

While the portion of the truncated cone 20 is provided for heating, the tubular portion 21 may serve for the purpose of fixing the heating element 2 in the device. The tubular portion 21 may also serve positioning purposes, to position an aerosol-generating article mounted on the heating element at a defined longitudinal position relative to, for example, a mouthpiece or an inductor in case of inductive heating.

In case of inductive heating, the truncated cone 20 may be made or covered by susceptor material. The height 202 of the truncated cone 20 corresponds to the height of an aerosol-generating article, for example as shown in FIGS. 1 and 2, mounted to the heating element. Preferably the entire surface of the truncated cone 20 is covered by the aerosol-generating article and preferably an entire inside of the aerosol-generating article is in contact with the truncated cone 20 portion of the heating element 2. Thus, the top diameter 201 of the truncated cone 20 corresponds to the inner diameter of the top of the article and the base diameter 200 of the heating element corresponds to the inner diameter of the base of the article.

Preferably, the apex angle 204 of the cone 20 corresponds to the apex angle 104 of an aerosol-generating article mounted to the heating element.

Figure 5:
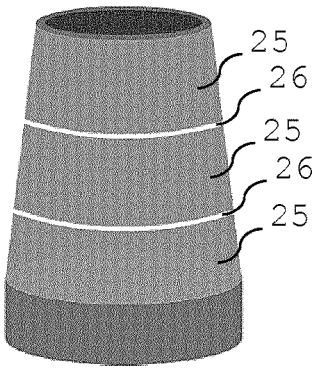
FIG. 5 shows a heating element for segmented heating.

FIG. 5 shows an example of a heating element 2 designed for segmented heating. The heating element is comprised of three heating segments 25. The heating segments 25 are separated by isolating gaps 26 or material strips of non-resistively or non-inductively heatable material. An aerosol-forming substrate may be heated in segments proportional to the segments 25 of the heating element.

Figure 6:
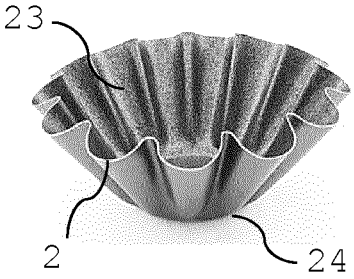
FIG. 6 shows a heating element with a structured surface.

FIG. 6 shows a heating element 2 in the form of a truncated cone with a closed top 24 having a structured wall 23. The wall 23 forms a wavy line when seen in a cross section parallel to the top 24 or base of the cone. The structure is regular along the circumference of the cone. The structure converges versus the top 24 of the cone and is smaller at or versus the top 24 of the cone and larger at or versus the base of the cone.

Preferably, this form of heating element 2 is used in combination with an aerosol-generating article having a same wall structure.

Figure 7:
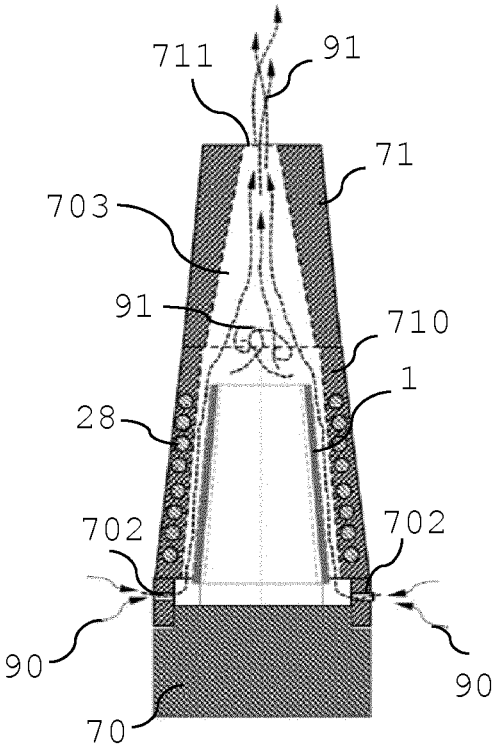
FIG. 7 shows a cross section though a mouthpiece section of an aerosol-generating system.

FIG. 7 shows a mouthpiece portion of an inductively heatable aerosol-generating system. The mouthpiece 71 comprises a conically shaped hollow distal portion 710. An induction coil 28 is embedded in the walls of the conically shaped hollow distal portion 710. The aerosol-generating article 1 is arranged on the heating element (not shown) and in the conically shaped hollow distal portion 710.

If a heating element for segmented heating, for example as shown in FIG. 5 is used, the induction coil may be comprised of several induction coils, wherein preferably each induction coil is provided for heating one segment 25 of the heating element 2.

The mouthpiece 71 or the main housing 70 is provided with radially arranged air-inlet channels 702 to allow air 90 from the environment to enter the housing 70 and pass between aerosol-generating article 1 and distal portion 710 of the mouthpiece 71. Thereby, the air 90 picks up aerosol formed by heating the aerosol-forming substrate of the article 1. The aerosol containing air 91 continuous further downstream into a mixing chamber 703 in the mouthpiece 71, then leaving the device 7 through an outlet opening 711 of the mouthpiece 71 at the proximal end of the mouthpiece.

In FIG. 7, the air-flow is indicated as an air-flow along the outside of the article 1 and, for example, for an article and/or a heating element 2 having a closed top.

Figure 8:
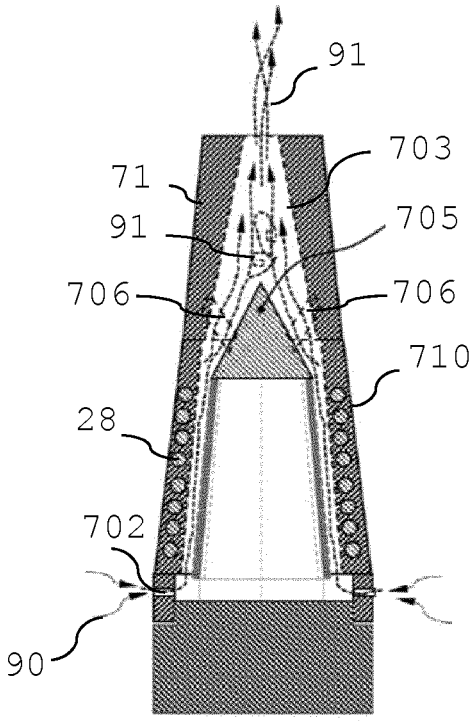
FIG. 8 shows a cross section through a mouthpiece section of the aerosol-generating system including centering and air-flow alteration element.
Figure 9:
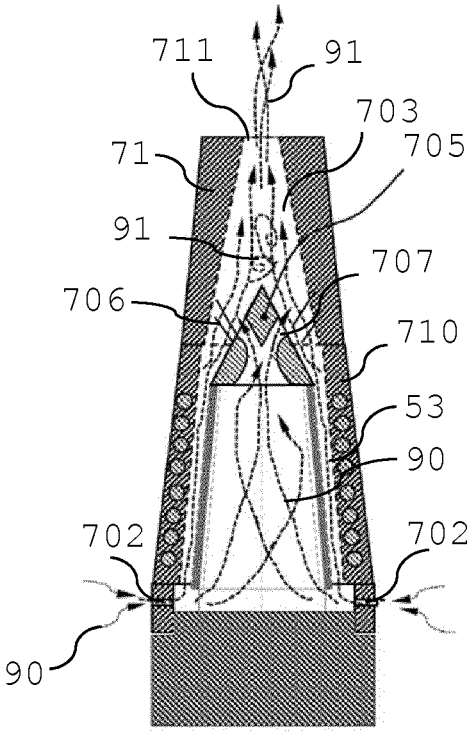
FIG. 9 shows a cross section through a mouthpiece section of the aerosol-generating system including another centering and air-flow alteration element.

FIG. 8 and FIG. 9 illustrate the mouthpiece portion of FIG. 6, however with different airflow management. In both embodiments a support element 705 is arranged in the mouthpiece 71. In the mounted position of the mouthpiece, the support element 705 assures self-centering and positioning of the article 1 on the heating element. The support element 705 is a cone influencing the airflow 91 and the mixing of the airflow 91 in the mixing chamber 703 of the mouthpiece 71.

The support element 705 is attached to the mouthpiece by fins 706.

In FIG. 8, the support element 705 is a solid cone, while the support element in FIG. 9 comprises passageways 707 through the mouthpiece 71. Such a support element is particularly suited for an airflow management, where an air-flow passes through the inside of the aerosol-generating article 1 and the heating element 2. In the mixing chamber 703, a portion of the airflow 90 passing through the inside of the article 1 and through the passageways 707 in the support element 705 combine with the portion of the airflow passing the outside of the article 1. The thoroughly mixed aerosol containing airflow 91 then leaves the mouthpiece 71 through the outlet opening 711.

In FIG. 9, the air-flow is indicated as an air-flow along the inside as well as along the outside of the article and for an article having an open top.

FIG. 10*a-c* are exploded and an assembled view of an embodiment of an aerosol-generating system 8 with an aerosol-generating article 1 in the form of a truncated cone as shown and described herein. The aerosol-generating device 7 of the system has a general tubular form and comprises a main housing 70 and a mouthpiece 71. The main housing 70 mainly comprises a battery and a power management system (not shown).

The device housing 70 comprises a heating element 2 extending from the proximal end of the device housing 70. Electrical contacts 27 are provided between the heating element 2 and the power management system of the housing 70. The heating element 2 has the shape of a truncated cone corresponding to the shape of the article 1. When mounted on the heating element 2, the article 1 entirely covers the truncated cone of the heating element 2.

The mouthpiece 71 forms the proximal or most downstream element of the device 7. The mouthpiece 71 comprises a conical section 710 surrounding a cavity (not shown) arranged within the conical section 710 of the mouthpiece. The cavity is provided for receiving and covering the aerosol-forming article 2 when the system is in the assembled state.

For preparing the system for use, the mouthpiece 71 is removed from the housing 70, such as to provide open access to the heating element 2.

After mounting an aerosol-forming article 1 onto the heating element 2, the previously removed mouthpiece 71 may be repositioned on the housing 70, such that the device 7 is now ready for use.

The mouthpiece 71 may comprise an inductor (not shown), for example in the form of an inductor coil, for inductively heating susceptor material contained in the heating element. The inductor coil is preferably arranged to surround the cavity in longitudinal direction of the mouthpiece 71 and positioned to be able to heat the susceptor material of the heating element 2.

The main housing 70 or the distal end of the mouthpiece, or both, may be provided with air-inlet channels (not shown) to allow air from the environment to enter the mouthpiece and pass the aerosol-generating article 1 and the cavity respectively. The air inside the mouthpiece 71 may pick up aerosol formed by heating the aerosol-generating article 1. The aerosol containing air continuous further downstream leaving the device 7 through an outlet opening 711 of the mouthpiece 71 at the proximal end of the mouthpiece 71.

Another embodiment of an aerosol-generating system 8 for receiving an aerosol-generating article 1 in the form of a truncated cone as shown and described herein, is schematically illustrated in FIG. 11. The same reference numerals are used for the same or similar elements as in the system of FIG. 10*a-c*.

The aerosol-generating device 7 comprises a main housing 70 and a mouthpiece 71. The main housing 70 mainly comprises a battery 700 and a power management system 701. The device housing 71 comprises a distal section 712 surrounding a recess 709 in the distal section 712 of the housing 70. The heating element 2 in the form of a truncated cone is arranged in the recess 709. An aerosol generating article 1 is mounted to the heating element 2. Both, heating element 2 and aerosol-generating article 1 are surrounded by the distal section 712.

The mouthpiece 71 may be a simple hollow cone, which may be reassembled with the device housing 70 and provide a positioning effect for the aerosol-generating article 1 on the heating element 2.

If resistively heated, the heating element 2 may be an electric heater as known in the art. If inductively heated, the heating element 2 comprises or is made of susceptor material and an induction coil may be embedded in the distal section 712 of the housing 70. The bottom of the recess of the housing 70 may be closed by a porous element, for example a grid or mesh. The porous element allows an air-flow to pass through the porous element, through the recess 709 and through the mouthpiece 71. To achieve this, the main housing 70 may be provided with air-inlet channels to allow air from the environment to enter the housing 70 and pass the aerosol-generating article 1 and the recess 709, respectively. The air inside the recess 709 may pick up aerosol formed in the recess 709 by heating the aerosol-generating article 1. The aerosol containing air continuous further downstream leaving the housing 70 and passing through the mouthpiece 71 and through the outlet opening 711 of the mouthpiece 71 at the proximal end of the mouthpiece.

The invention claimed is:

1. An aerosol-generating system comprising:

an aerosol-generating article comprising:

an aerosol-forming substrate comprising homogenized tobacco material and an aerosol-former, the aerosol-forming substrate being molded to form the aerosol-generating article, the aerosol-generating article being a hollow frustum with an open base, a closed top, and a conical side wall, and an interior face and an exterior face of the side wall have a corresponding shape and orientation, wherein the conical side wall and the closed top of the aerosol-generating article are formed by the aerosol-forming substrate, wherein a wrapping material covers the interior face of the side wall of the aerosol-generating article serving as an interface between the aerosol-forming substrate and a heating element of the aerosol-generating device, and wherein a wrapping material covers the exterior face of the side wall, and the wrapping material that covers the interior face of the side wall and the wrapping material that covers the exterior face of the side wall are made of a same material; and an electronic aerosol-generating device comprising a mouthpiece and a device housing, the device housing comprising a heating element having a shape comprising a frustum, wherein the aerosol-generating article is mounted to the heating element with the interior face of the side wall of the aerosol-generating article having a corresponding shape and orientation with a lateral surface area of the frustum of the heating element, thereby forming a close contact between the heating element and the aerosol-generating article, and with the wrapping material covering the interior face of the side wall of the aerosol-generating article serving as an interface between the aerosol-forming substrate and the heating element, wherein a height of the heating element corresponds to a height of the aerosol-generating article, and wherein the mouthpiece comprises an internal conical wall, and the internal conical wall of the mouthpiece and the lateral surface area of the frustum of the heating element have a corresponding shape and orientation, wherein the wrapping material on the exterior face of the side wall is immediately adjacent to the internal conical wall of the mouthpiece.

2. The aerosol-generating system according to claim 1, wherein an apex angle of the hollow frustum is between 1 degree and 30 degrees.

3. The aerosol-generating system according to claim 1, wherein a wall thickness of a lateral surface area of the hollow frustum is between 0.3 millimeters and 3 millimeters.

4. The aerosol-generating system according to claim 1, wherein the hollow frustum comprises a structured lateral surface area.

5. The aerosol-generating system according to claim 1, wherein the aerosol-forming substrate is cast leaf tobacco.

6. The aerosol-generating system according to claim 1, wherein the mouthpiece comprises a support element arranged inside the mouthpiece, the support element being at least one of a centering element and an air-flow alteration element.

7. The aerosol-generating system according to claim 1, wherein the heating element extends over a proximal end of the device housing.

8. The aerosol-generating system according to claim 1, wherein the heating element comprises an inductively heatable material, and wherein an inductor is arranged in the electronic aerosol-generating device such that the inductor is inductively coupled to the inductively heatable material of the heating element in operation of the device.

9. The aerosol-generating system according to claim 8, wherein the inductor is arranged in the mouthpiece.

10. The aerosol-generating system according to claim 1, wherein a thickness of the side wall is constant.

11. The aerosol-generating system according to claim 1, wherein the lateral surface area of the frustum of the heating element is arranged equidistantly to the internal conical wall of the mouthpiece.

12. The aerosol-generating system according to claim 1, wherein the wrapping material is a porous sheet material.

13. The aerosol-generating system according to claim 12, wherein the porous sheet material is a porous paper material or plastics material.

14. The aerosol-generating system according to claim 1, wherein the wrapping material covers the top of the hollow frustum.

15. The aerosol-generating system according to claim 1, wherein a height of the article is between 4 millimeters and 12 millimeters.

16. The aerosol-generating system according to claim 1, wherein the heating element comprises several individual segments for a segmented heating of the aerosol-generating article.

17. The aerosol-generating system according to claim 1, wherein a thickness of the wrapping material on the exterior face is between 10 and 50 micrometers.

* * * * *